United States Patent [19]

Chaudot

[11] Patent Number: 4,649,994

[45] Date of Patent: Mar. 17, 1987

[54] INSTALLATION FOR BRINGING HYDROCARBON DEPOSITS INTO PRODUCTION WITH REINJECTION OF EFFLUENTS INTO THE DEPOSIT OR INTO THE WELL OR WELLS

[76] Inventor: Gérard Chaudot, 14, Allée de La Rochefoucauld, 78570 Andresy, France

[21] Appl. No.: 656,592

[22] Filed: Oct. 1, 1984

Related U.S. Application Data

[63] Continuation-in-part of Ser. No. 509,438, May 31, 1983, abandoned.

[51] Int. Cl.[4] ..... E21B 33/068; E21B 43/00; F04F 1/08

[52] U.S. Cl. ..... 166/68; 166/369; 417/137

[58] Field of Search ..... 166/68, 63, 105, 299, 166/302, 369, 370, 372, 373, 374, 305 R, 325, 61, 62, 267; 417/54, 65, 73, 85, 137

[56] References Cited

U.S. PATENT DOCUMENTS

| | | | |
|---|---|---|---|
| 1,574,498 | 2/1926 | Macready | 417/54 |
| 2,272,477 | 2/1942 | Pfleger | 417/73 |
| 2,765,850 | 10/1956 | Allen | 166/267 |
| 2,767,793 | 10/1956 | Kramer | 166/61 |
| 3,334,690 | 8/1967 | Garrett | 166/372 |
| 3,343,605 | 9/1967 | Phelan, III | 166/61 |
| 3,552,491 | 1/1971 | Thompson | 166/325 |
| 4,025,235 | 5/1977 | Newbrough | 417/54 |
| 4,424,862 | 1/1984 | Munari et al. | 166/305 R |
| 4,480,697 | 11/1984 | Goldaniga et al. | 166/372 |

*Primary Examiner*—Stephen J. Novosad
*Assistant Examiner*—Bruce M. Kisliuk
*Attorney, Agent, or Firm*—Scully, Scott, Murphy & Presser

[57] ABSTRACT

An installation is provided for bringing into production hydrocarbon deposits with reinjection of effluents into the deposit or into the well or wells and a process for using this installation. Said installation comprises at least one sealed casing whose base communicates with the deposit; at least one sealing plug disposed in the lower part of the casing and forming a capacity; at least one duct for either injecting or removing a pressurized gas; a condensate injection pipe passing through the capacity and opening into the base of the casing beyond said plug; a production pipe passing through said capacity and possibly through said plug, this pipe communicating with the inner volume of the casing downstream of the plug, as well as with said capacity through a valving system.

5 Claims, 19 Drawing Figures

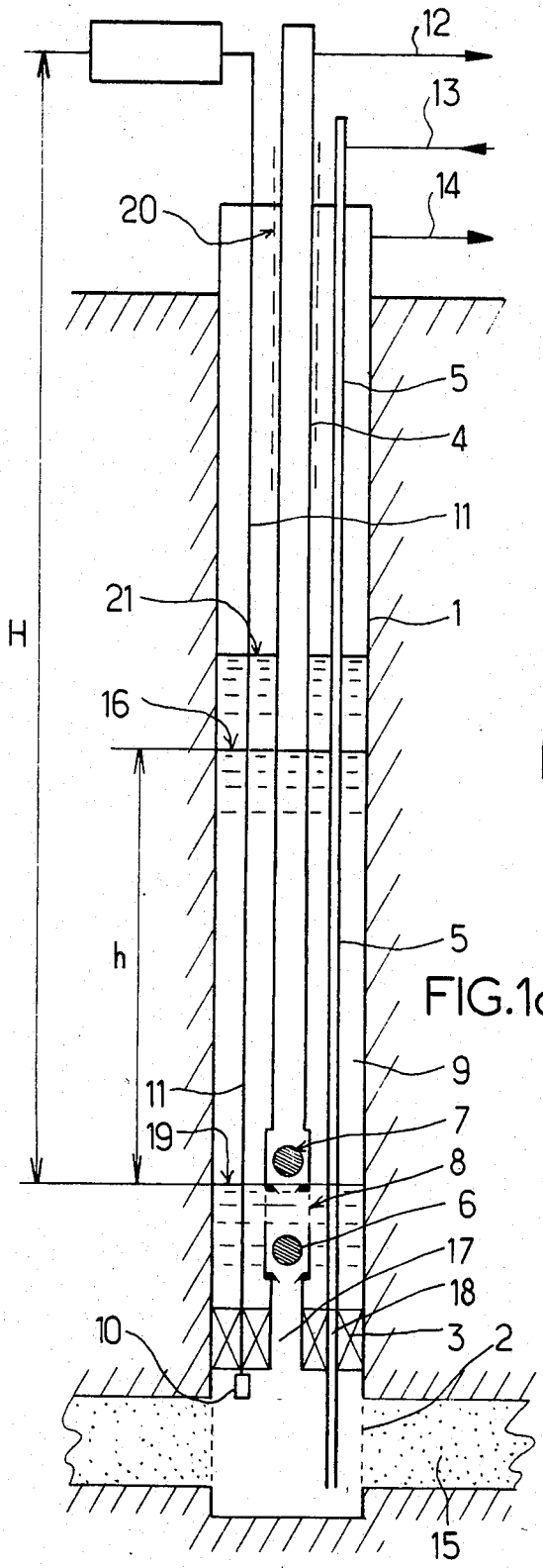
FIG.1a
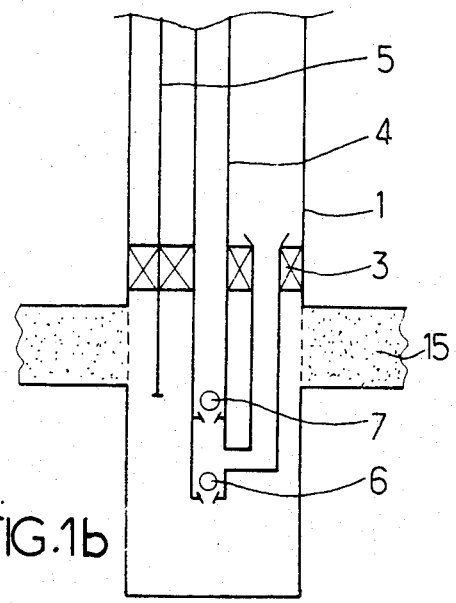
FIG.1b
FIG.1c
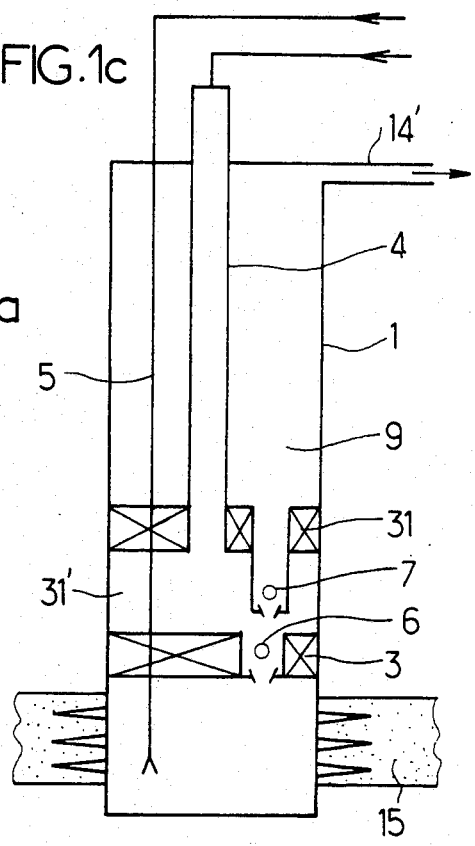

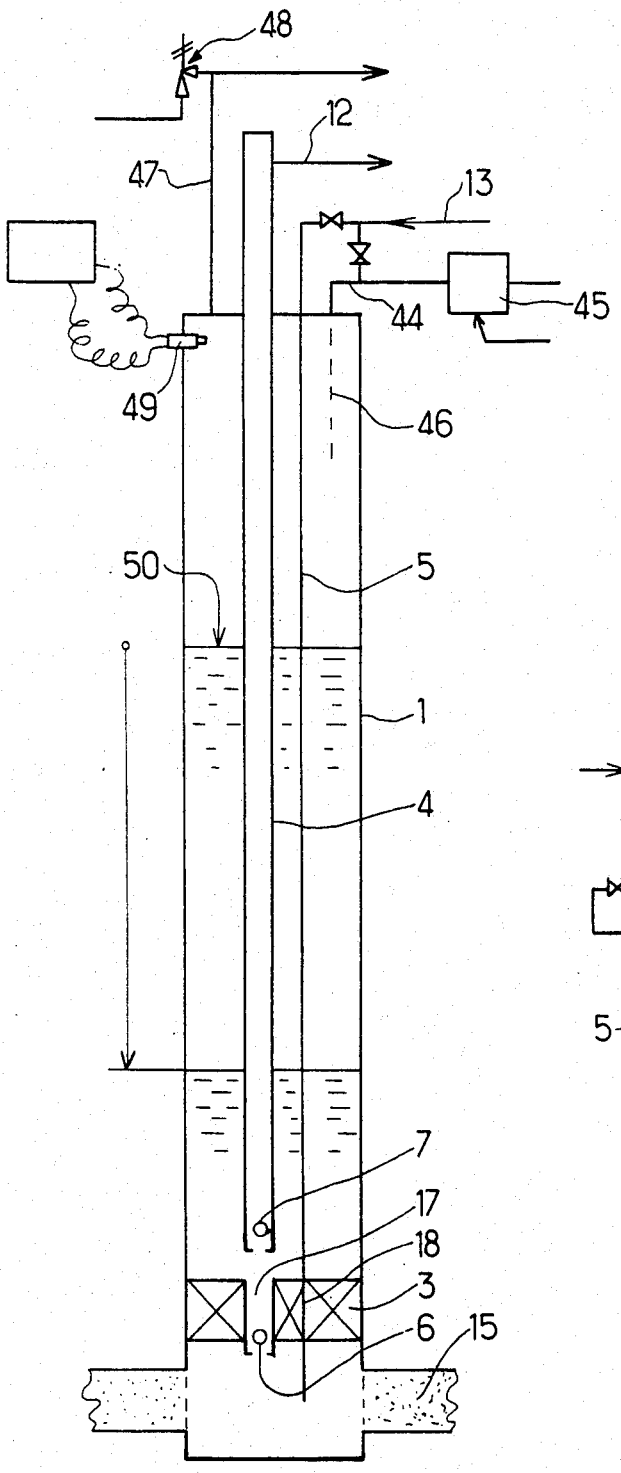
FIG. 7a
FIG. 7b
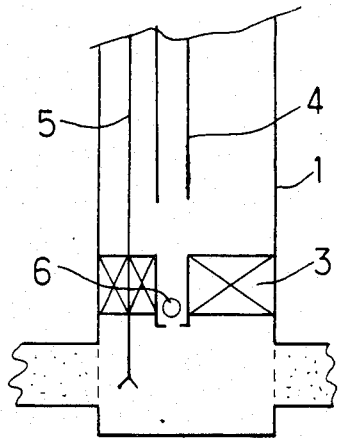
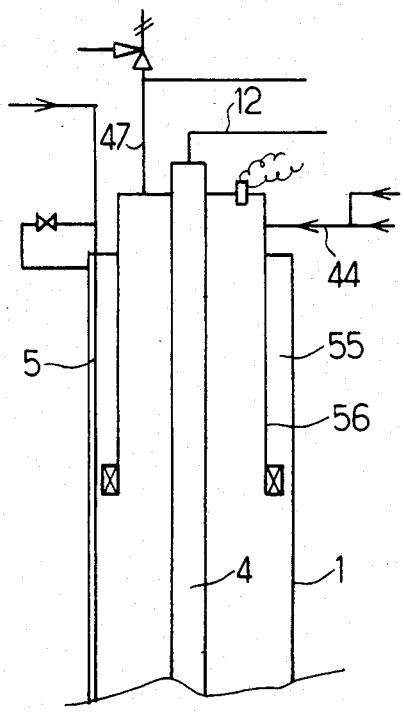
FIG. 7c

INSTALLATION FOR BRINGING HYDROCARBON DEPOSITS INTO PRODUCTION WITH REINJECTION OF EFFLUENTS INTO THE DEPOSIT OR INTO THE WELL OR WELLS

CROSS-REFERENCE TO RELATED APPLICATION

This application is a continuation-in-part of application Ser. No. 509,438, filed May 31, 1983 now abandoned.

BACKGROUND OF THE INVENTION

1. Field of the Invention

The present invention relates to an installation for bringing hydrocarbon deposits into production with reinjection of effluents into the deposit or into the well or wells according to the process forming the subject of the parent application and a process for using this installation.

2. Description of the Prior Art

It will be recalled that the working process forming the subject of the parent patent application is intended to maximize recovery of the fluids of liquid hydrocarbon deposits, and to facilitate working thereof, with application, in particular, to heavy and/or viscous hydrocarbon deposits and to hydrocarbon deposits having a high coagulation point.

It will be recalled that this process brings into play recovery of the light condensable and/or gas fractions of the effluent and reinjection thereof into the well or wells and/or the deposit. It comprises heating the effluent coming from the well, separating the gas, liquid and solid phases of the effluent, the compression, cooling and dehydration of the gaseous phase with recovery of the hydrocarbon condensates and reinjection of the liquid phase condensate into the well or into the deposit.

Now, the traditional working of hydrocarbon deposits generally leads to leaving in the deposit a considerable part of the hydrocarbons originally in place for different reasons, some of which are recalled hereafter:

either the crude oil is very viscous and tends to remain entrapped in the matrix in the deposit itself;

or the oil rests on a layer of water which tends to flow more easily than the oil, leading to flooding the production well in a practically irreversible way (water coning);

or the oil underlies an accumulation of gas which will tend to flow more easily than the oil (gas coning), leading to an increase in the production of gas to the detriment of oil production;

or the oil deposit is of small thickness and inserted between a water layer and a gas pocket;

or the pressure of the crude oil in the deposit is too low naturally or because of prior tapping and no longer provides conveyance thereof to the surface, mainly at sea, or if highly deflected production wells are used;

or the crude oil is too viscous and the deposit too deep, to be able to use known production processes and methods;

or the components of the crude oil, coagulate, flocculate or are deposited from the deposit itself as far as the surface installations, because of bringing the deposit into production and thus making working of the deposit very uncertain;

or the surface environment, particularly at sea, and also in regions with a very cold climate does not allow known methods to be used.

For the larger majority of deposits, it is thus necessary to fix a pressure beyond which it is no longer worth while to work the deposit, unless, for some of them, working cannot even be started.

The known processes and techniques relate, on the one hand, to improving the productivity of production wells, mainly by pumping, gas lift and, on the other hand improvement of the displacement of the crude oil in the matrix of the deposit by heating, using water vapor or in situ combustion or by displacement of the crude oil towards the production wells using appropriate fluids injected into specialized wells. These methods, always costly, give sometimes unexpected results and are limited in their applications by factors such as:

the depth of the deposit and its pressure;

the deflection of the wells;

production costs;

possibilities of implementation.

Furthermore, though some are applicable for deposits located on land, they become rapidly unusable at sea when the depth of water is appreciable or when the climatic conditions are harsh.

Finally, in practically all cases, the decision to develop a deposit is founded on the estimate of the recoverable part of the reserves discovered. Should the deposit not behave in the expected way, should it not react well to the treatments which are inflicted on it so as to increase its potential or should the price of crude oil drop, then working of the deposit may lead to the limits of profitability.

SUMMARY OF THE INVENTION

The purpose of the invention is then to overcome all or part of these drawbacks and hazards, to allow deposits to be brought into production which are inaccessible by using traditional processes and to allow additional recovery from deposits reaching exhaustion or already exhausted and abandoned. Furthermore, even if a long period of non working must be contemplated, it allows the production wells and the deposit to be left in such a state that it will be easy to reinitiate production as soon as the technical conditions or working economics have again become favorable.

To reach these results, the production installation of the invention comprises at least:

a sealed casing whose base is in communication with the deposit;

at least one sealed plug disposed in the lower part of the casing and forming, with the upper part of this latter, a capacity:

at least one duct opening into the upper part of said capacity, this duct allowing either a gas purge or pressurized gas injection to be carried out in said capacity;

a condensation injection pipe passing through the capacity and opening in the base of the casing beyond said plug;

a production pipe passing through said capacity and possibly said plug, this pipe communicating, in its upper part, with an effluent discharge pipe and, in its lower part, with the inner volume of the casing downstream of the plug, as well as with said capacity, through a valving system for obtaining an operating cycle comprising at least the following phases:

During an initial phase, the valving system lets the effluent through to the inside of the capacity which is then filled.

During a second phase, during which a pressurized gas is injected into the capacity through said duct, the valving system prevents the effluent contained in the capacity from returning to the deposit, while it allows it to pass to the discharge pipe through the production pipe (gas flushing), this second phase further comprising simultaneously injection of condensates into the deposit, and During the third phase, the valving system retains the effluent column if required in the production pipe and allows the effluent mixed with the condensates injected into the deposit to pass towards the capacity, so that a new cycle may begin.

In order to facilitate understanding and to bring out the advantages, the description will be made by way of non limitative example from an apparatus for bringing into production a deposit containing viscous crude oil at a bottom pressure too low to cause the effluent to rise to the surface.

DESCRIPTION OF THE DRAWINGS

FIG. 1*a* shows schematically a simple method of completing a well;

FIGS. 1*b* and 1*c* represent variants of the embodiment shown in FIG. 1*a;*

FIGS. 5*a* to 5*d* show schematically the evolution of the pressures and the filling state of a well during a production cycle;

FIG. 7*a* shows another embodiment of the installation of the invention;

FIGS. 7*b* and 7*c* are variants of the installation shown in FIG. 7*a*.

DESCRIPTION OF THE PREFERRED EMBODIMENTS

Figure 2A:
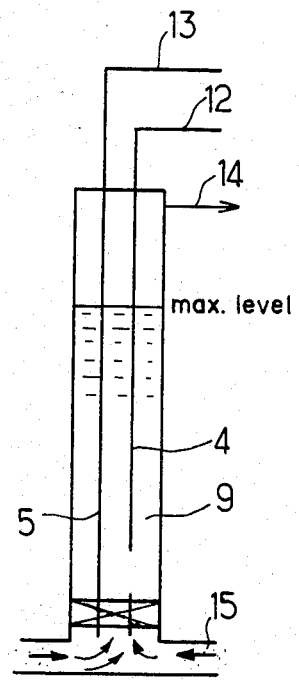
FIGS. 2*a* to 2*e* show schematically the different phases of the production cycle of a well completed as shown in FIG. 1.
Figure 2B:
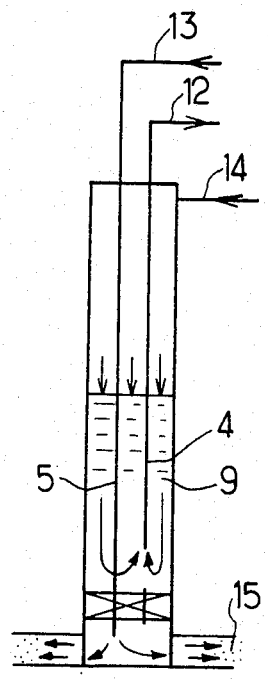
Figure 2C:
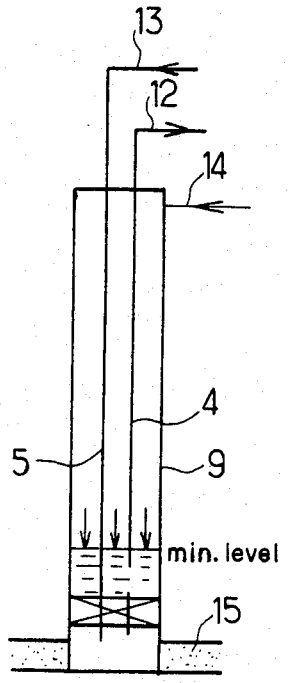
Figure 2D:
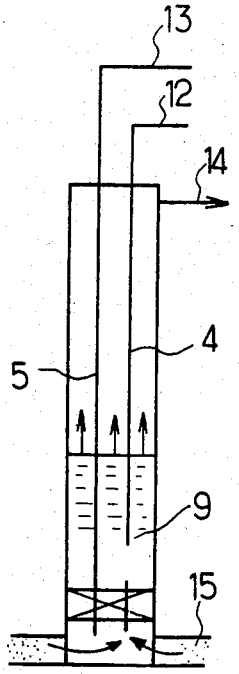
Figure 2E:
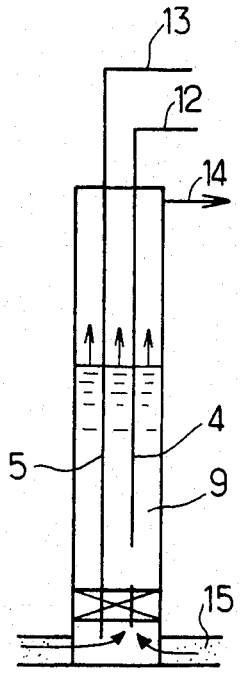

With reference to FIG. 1, the production well comprises a sealed casing 1 providing connection between the deposit 15 and the surface. It comprises at its base a perforated part or strainer 2 communicating the deposit with the inside of the casing. Furthermore, casing 1 is provided, on the inside and at its lower part, immediately above the deposit, with a sealed plug 3 (production packer) through which pass two main sealable orifices 17 and 18, one 17 allowing fluids to flow through an oil production pipe 4 and the other 18 for injecting liquid or partially gaseous light hydrocarbons, called hereafter condensates, through a condensate injection pipe 5.

This sealed plug 3 defines in the upper part of the well a capacity 9 in which the fluids may be accumulated which are produced by the deposit and mixed with the injected condensates, before transfer thereof to the surface through pipe 4, this latter being equipped with two check valves 6 and 7 separated by a perforated pipe 8 for placing alternately in communication the deposit 15, the capacity 9 and the inside of the production pipe 4.

Accessorily, a bottom pressure and temperature sensor 10 will allow the pressure and temperature variations below the lower valve 6 to be measured. This information will be transmitted to the surface by a cable 11 equipped with packing boxes for maintaining the required seal.

On the surface, the well is equipped with a pipe 12 for conveying the fluids produced as far as the separation-processing installations and a second pipe 13 for conveying the condensate injected under pressure into the well. Furthermore, a pipe 14 will be connected at the head of the sealed casing 1 for injecting and withdrawing the driving gas.

With this equipment, the operating cycle of the well will be as follows:

At the beginning of the cycle, the well is at rest and, under the effect of the pressure in deposit 15, the liquids have reached the level 16 in casing 1 by passing through the orifice 17 formed in the sealed block 3, by raising the lower valve 6 and by invading the capacity 9 through the strainer equipped tube 8. The level reached in the production pipe 4 will be substantially close to level 16 if the pressures at the head of casing 1 and pipe 4 are identical. Valves 6 and 7 rest on their seats under the effect of their own weight.

Then pressurized gas is injected through pipe 14. This injection will accentuate the closure of valve 6, and open valve 7, the liquids accumulated in casing 1 flowing downwards then through the strainer-equipped tube 8 and valve 7 upwards in pipe 4. If the pressure of the injected gas is sufficient level 16 may drop as far as level 19, at which level gas will begin to pass through the tube 8 and rise again in pipe 4. At this point, the maximum pressure of the driving gas will be conditioned by the lift height H of the fluids through pipe 4, and the volume of liquids displaced will depend on the difference between level 16 at the beginning of flushing and 19 at the end of flushing.

During this displacement, since the pressure reigning above value 6 is greater than the pressure reigning below, condensates will be injected at the level of the production layer 15 through the condensate injection pipe 5. Because of the counter pressure maintained above valve 6, these condensates will invade the deposit 15 in the vicinity of the well and consequently reduce the viscosity of the crude oil in the deposit and increase the relative permeability to the crude oil mixed with condensate, thus promoting subsequent flow towards the well in the zone invaded by the condensates.

After this gas flushing, pressure of the gas is lowered by draining off the gas through pipe 14 for example. Valve 7 will close again under the effect of the weight of the column of liquids accumulated in the production pipe 4 and valve 6 will open as soon as the effect of the bottom pressure is greater than the effect of the pressure reigning in casing 1, and the crude oil mixed with the previously injected condensates will again flow and fill casing 1 as far as level 21. The delivery cycle on the surface may then be started up again.

If one or more other wells participate in the production of the deposit, the pressurized gas accumulated in casing 1, after flushing of liquids, may be used directly in another well ready to be flushed, so as to displace the liquids therein until the pressures in the two wells are balanced.

The energy efficiency of the production will thus be considerably improved provided that an assembly of valves is installed for balancing the gas directly from one well to the others.

Since the main wearing parts are the foot valves 6 and 7, they may be withdrawable simultaneously or independently of each other, through the inside of the production pipe 4 and reanchored after checking or exchange on the surface. Their positioning and dismantling being carried out by conventional methods, such as pumping or the use of a wire line. For some applications, or depending on the state of exhaustion of the deposit, the production pipe 4, equipped with its foot valve 7, may be lowered step by step depending on the end result sought, valve 6 remaining in the vicinity of the sealed plug 3. Other applications will not require the installation of the upper valve 7 either because a drop of the fluids accumulated in pipe 4 at the end of flushing will be accepted, or because gas accumulated in casing 1 will be allowed to escape through the lower end of the production pipe 4 so as to lighten and push the remaining liquids into pipe 4.

Some applications may require one or more calibrated orifices spaced apart along pipe 4 so that the gas accumulated in the top of casing 1, under certain conditions, may penetrate laterally at one or more levels into pipe 4 during the flushing of the liquids, in order to reduce the mean density of the column of fluids flowing in pipe 4. Such an arrangement will promote the gas lift.

If the pressure of the deposit is very low, the foot valves 6 and 7 may even be placed facing and even below the level of deposit 15 so as to allow tapping of the deposit, its life thus to be extended and even an abandoned deposit to be brought back into production. In this case, the part of the production pipe between valves 6 and 7 is connected to the capacity through a duct.

FIG. 1*b* gives by way of example the corresponding diagram of the arrangement of the equipment at the bottom of the well.

Furthermore, other applications such as those shown in FIG. 1*c* will require reversal of the flows in casing 1 and production pipe 4. In this example, casing 1 is closed by two sealed plugs 3, 31 which pass through the condensate injection pipe 5. These two plugs 3, 31 define an intermediate chamber 31' into which the production pipe 4 emerges. Capacity 9 which is then defined by the upper plug 31, communicates with the intermediate chamber 31' through a duct equipped with a foot valve 7. The lower plug 3 comprises a passage in direction of the deposit equipped with a second foot valve 6. Moreover, the casing may comprise, in its upper part, an outlet duct 14' for discharging the effluent and the condensate. The gas lift to the surface will then take place through the main casing 1 and displacement gas injection through pipe 4. Of course, the foot valve 6 and 7 will be installed so as to allow correct operation.

The flow rates of the condensates and the quality thereof will be adjusted progressively, depending on the recovery thereof from the crude oil produced, and depending on the desired effects of which the main ones are the following:

reduction of the viscosity of the crude oil;
reduction of the density of the crude oil;
increase in the productivity of the wells;
increase in the recovery of the crude oil in place in the deposit;
lowering of the coagulation point of the crude oil;
raising of the bubble point of the crude oil in the well, even in the deposit, so as to overcome the problem of deposition of asphaltenes or other compounds which may precipitate or risk causing choking in the deposit and/or in the wells;
inhibition or occultation of the gas layer lowering or water layer raising phenomena, or both simultaneously, even if they are largely developed; in this particular case, the properties of the injected condensates may be modified by adding a fraction of the crude oil produced, foreign fluids, ammonia, for example, and/or chemical products promoting the efficiency of the process depending on the problem to be solved.

To attain said desired effects, the condensates may be remixed with a gaseous fraction before injection, or a liquid gas fraction, but becoming again voluntarily gaseous during its transfer to the deposit 15, or else the recovered condensates are fractionated so as to only injeot one or more fractions thereof for solving a particular problem. In addition, if the conditions of the deposit 15 and working thereof require it, only the intermittent or continuous injection of condensates improved by foreign fluids or not will be carried out, the gases coming from the separation of the crude oil and the condensates not being used again in the wells.

FIGS. 2*a* to 2*e* illustrate, the different stages of the production cycle, the evolution of the fluids in the well and the manner in which the condensates are injected into the deposit.

Thus, in FIG. 2*a*, the effluent rises in the capacity whereas the flushing gas flows through pipe 14. This phase continues until the effluent reaches a maximum predetermined level in capacity 9.

During the second phase, a pressurized flushing gas is injected through pipe 14. Under the effect of this gas, the effluent rises through the production pipe and flows through the effluent outlet pipe. Conourrently, the condensate is injected into the deposit through pipe 13. As soon as a minimum level of the effluent is reached in the capacity (FIG. 2*c*), the injections of flushing gas and condensate are interrupted.

Then the gas in the capacity is drained off by transferring first of all the pressurized flushing gas into another well ready to be flushed until the pressures in the capacities of the two wells (FIG. 2*d*) are balanced. During this phase, the effluent begins to rise in the capacity.

Then complete draining of the capacity (2*e*) is undertaken so that the effluent may rise as far as the maximum level mentioned above. A new cycle may then begin.

Figure 3:
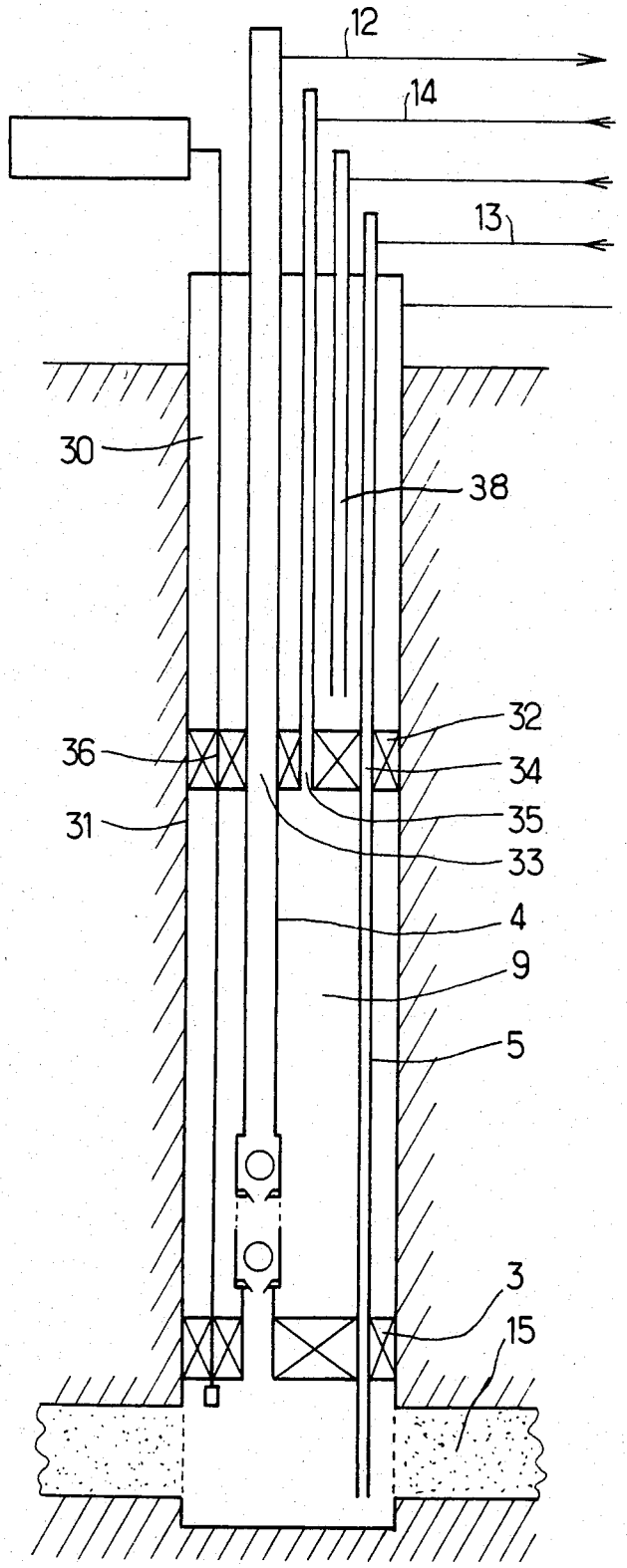
FIG. 3 shows schematically the completion of a well with integrated storage.

With reference to FIG. 3, the preceding completion of the well as shown in FIG. 1 is further improved by the creation of a pressurized gas storage chamber 30 in the upper part of the well and correlatively by reduction of the "dead" volume of gas not participating in the effective flushing of the liquids accumulated in casing 1. In fact, it is advantageous, on the one hand, to have a considerable pressurized gas in reserve so as to facilitate, even accelerate, the liquid flushing phases and to allow rapid restart up of the production after a period of stoppage and, on the other hand, to occult a "dead" volume increasing with exhaustion of the deposit. Moreover, the well or wells may, at the beginning of working, be completed as shown in FIG. 1, then after partial exhaustion of the deposit be recompleted as shown in FIG. 3, while keeping if need be bottom equipment such as the sealed plug 3 and the accessories which are related thereto and previously installed. This gas storage may be provided by placing a permanent or removable plug 32 pierced with sealable orifices 33, 34, 35 and 36.

Orifice 33 will allow the expelled fluids to rise as far as the surface through pipe 4.

Orifice 34 allows condensates to be injected from the surface below the lower plug 3 through the continuous pipe 5.

Orifice 35 allows the intake and discharge of the fluid displacement gas, above the liquids accumulated in capacity 9.

Orifice 36 allows the data transmitting cable to pass from the bottom to the surface.

In order to simplify the sealed plug 32, several of the orifices 33, 34, 35 and 36 may be grouped together in a common passage through plug 32.

The gas storage chamber 30 thus created is supplied or tapped through a plunging pipe 38 which will allow the existing liquids or liquids which may accumulate in the lower part of the storage chamber 30 to be drawn off if required.

For some applications, the positroning of the scaled plug 32 may be with the sole purpose of reducing the dead space in the top part of casing 1 or of preventing pressures which are too high from being reached in the casing head 1, chamber 30 thus freed then not having any particular function of active gas storage.

Other applications will lead to using the storage chamber 30 for storing liquid hydrocarbon condensates, and even several wells of a deposit may have storage chambers 30 fulfilling simultaneously and/or successively the three previously defined functions of gas storage, "dead" space and condensate storage.

Figure 4A:
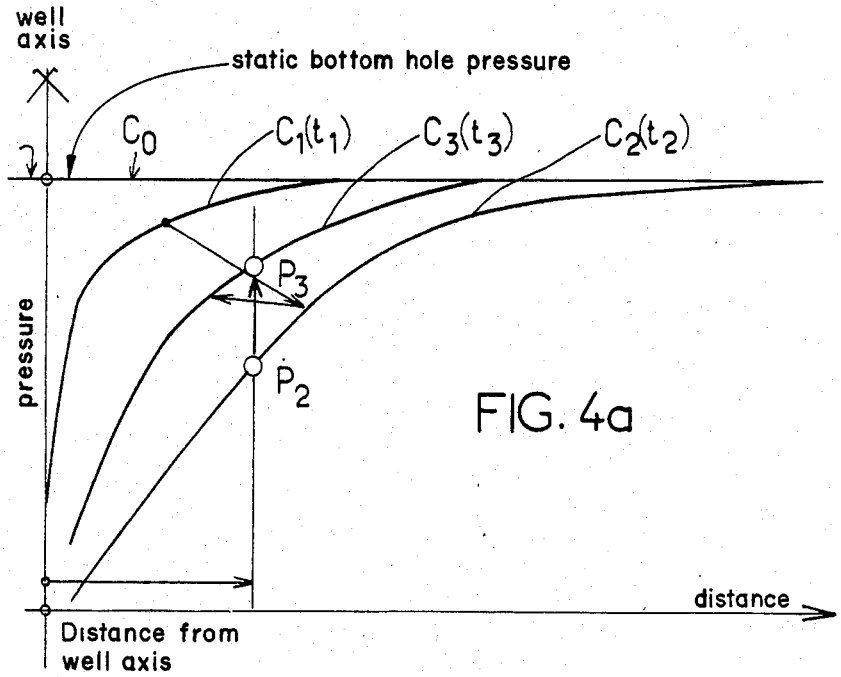
FIGS. 4*a* and 4*b* show schematically the evolution of the pressures in the deposit around the production well.
Figure 4B:
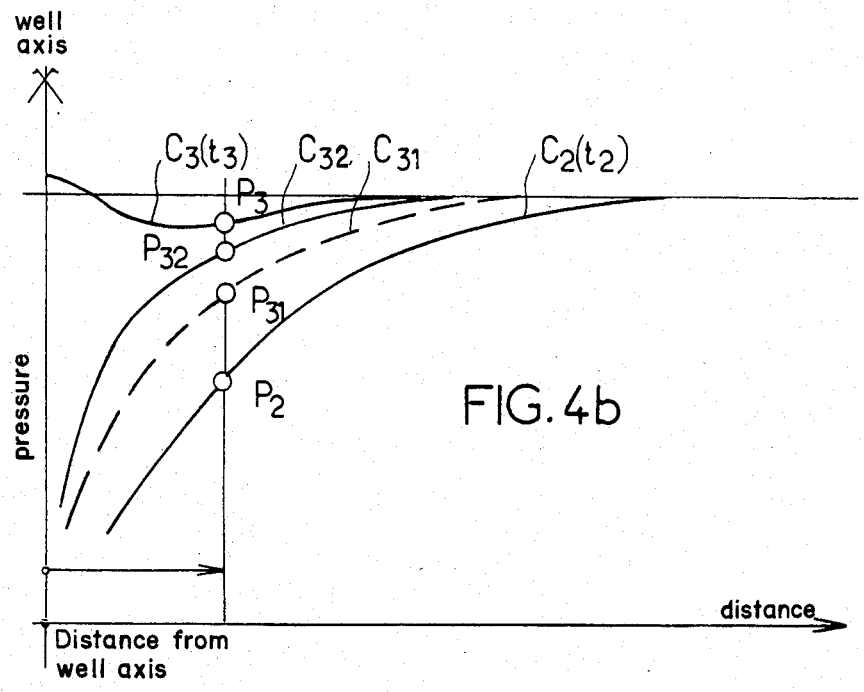

FIGS. 4*a* and 4*b* show schematically the comparison of the evolution of the pressure at the approaches of a well delivering continuously without injection of condensates and the evolution of the pressure at the approaches of a well delivering cyclically with condensate injection. In FIG. 4*a* there is shown, by way of comparison, tne evolution of the pressure in the deposit at the approaches of the well if this latter is continuously drawn off or drawn off by continuous pumping. It can be seen that the pressure which at the beginning of working (time To) is shown by a horizontal straight line Co will creep to curve C1 after a working time T1 then to curve C2 after a working time T2. If, after this phase of continuous working, the well is closed for a time T3, curve C2 will creep in the reverse direction as far as curve C3 and, for example, the pressure at a distance R from the axis of the well which dropped to the value P2 rises to the value P3.

Referring now to FIG. 4*b* which shows the evolution of the pressure in the well at the approaches of the well in which cyclic drawing off is carried out, it can be seen that the curve representing the pressure in the deposit at the approaches to the well will have reached the profile C2 after the drawing off time T2 of the cycle. With the well closed, it may be stated that the pressure would evolve in reverse direction after a closure time T3 and reach profile C3 if there were no injection of miscible condensate, througn the well in the production zone. But the injection of condensate will displace this latter curve for two reasons simultaneously.

First of all, under the effect of the lowering of viscosity of the crude oil and under the effect of the increase of the relative permeability to the crude oil-condensate mixture, the rise in pressure will be more rapid and curve C31 will creep to C32.

Secondly under the effect of the pressure rise, because of the injection of condensate through the well, curve C32 will pass to curve C3 still in the same lapse of time T3. Since the output of the well depends directly on the lowering of pressure, the instantaneous output may be higher and, on the other hand, with the lowering of pressure more uniformly distributed in a larger volume of the deposit, more distant regions of the well than previously will participate in the production, consequently the recovery of crude oil in place in the deposit will be considerably improved, without for all that necessarily using foreign fluids.

With reference to FIGS. 5*a* to 5*d*, there is now shown, in a triple diagram, the evolution of the pressure and the filling or emptying state of the well during a production cycle, with reference to the completion of the well shown in FIG. 1.

FIG. 5*a* shows the evolution of the pressure of the displacement gas at the head of the main casing 1 during the production cycle.

FIG. 5*b* shows the emptying and filling state of capacity 9 inside the main casing 1.

FIG. 5*c* shows the evolution of the pressure at the bottom of the well, below the sealed plug 3, and FIG. 5*d* shows the phases during which condensate injections may be carried out.

Figure 6:
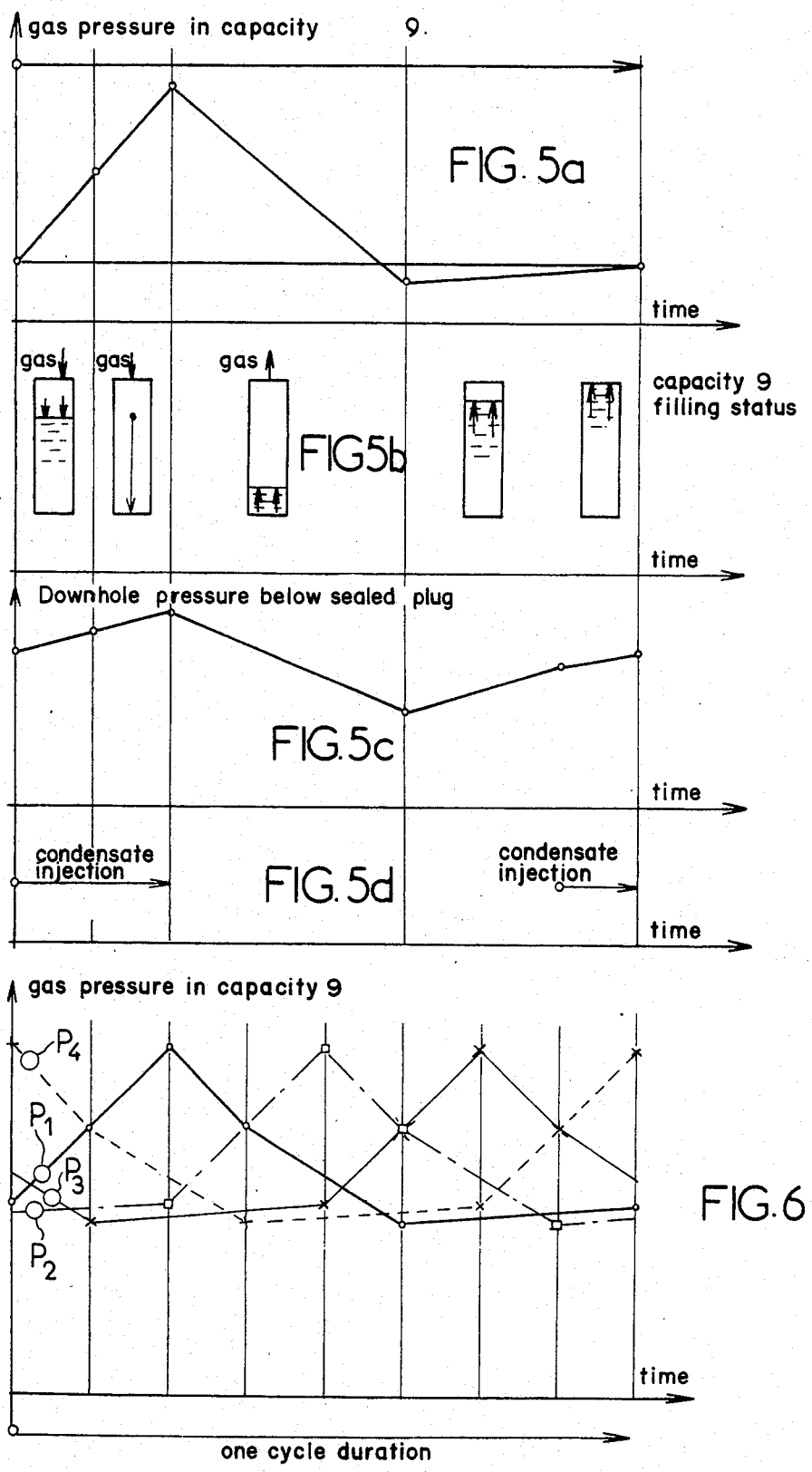
FIG. 6 shows the organization of production for four wells so as to improve the efficiency and profitability of the process when the number of wells in use is greater than one.

With reference to FIG. 6, there is shown there the staggering of the production cycles for four wells, for example curve P1, P2, P3, P4, so as to limit the installed power for compressing the displacement gas and so as to obtain as regular an output as possible of the mean production of the four wells.

A first advantage of the above described embodiments consists in the fact that gas is used cyclically for supplying the energy required for conveying the liquid hydrocarbons at least as far as the surface, the whole or a part of this propulsive gas being extracted from the production well or wells by partial or total removal of the gas from the hydrocarbons which are contained therein, said gas being injected and drained off alternately so as to allow, on the one hand, the pressure to rise in the deposit at the approach to the production well and the injection of hydrocarbon condensates into said well and said deposit and, on the other hand, the ejection of the liquids contained in said well. It is clear that by proceeding in this way, the pressure at the bottom of the well may reach a very low value, even less than the pressures at which the deposit is generally abandoned, in any case less than the bubble point of the crude oil in the deposit, without for all that generating insurmountable problems, the capacity 9 formed in the main casing 1 then playing the role of liquid and gas phase separator.

Thus breathing of the wells is voluntarily caused, this breathing being adjustable at will from the surface, in frequency, volume and pressure within the limits defined by the dimensional characteristics of the equipment of the wells and by the characteristics of the gas injection and condensate recovery installations, the crude oil output depending on its own characteristics, on those of the deposit, on the pressure difference imposed at the level of the deposit, on the volume and on the characteristics of the injected condensate. Furthermore, the liquids temporarily stored in capacity 9 of the main casing 1 may be flushed to the surface slowly or rapidly depending on the desired effect, i.e. slowly if it is desired to benefit from cooling by heat exchange with the ground passed through as far as the surface, even the sea, or rapidly if it is desired to reduce heat losses.

Thus, this improved process is applicable to deposits reaching exhaustion, even already abandoned.

It is also clear that the complementary energy supplied to the crude oil for it to reach the surface installations is not transmitted by mechanical or electrical means from the surface, which makes this process particularly advantageous for working wells which are greatly deflected from the vertical, even horizontal, said wells being possibly situated on land or at sea, without in fact any limitations because of the depth of water at right angles to the wells and/or the deposit, and thus allowing sufface production installations to be set up at a distance from the deposit without requiring more especially permanent vertical or sub vertical access at right angles to said wells or said deposit.

It may also happen that the matrix of the deposit is heterogeneous and that the conveyance of the oil is promoted in preferential channels (fingering and channelling). In this case, the production of the well or wells will be supplied from zones further and further away from the wells, whereas zones containing large amounts of oil situated in the vicinity of the wells will only participate very little in the production, this trapped oil remaining usually in placed in the deposit until working has been abandoned. The injection of condensate into the deposit, followed by production (rocking), will allow these zones, which are otherwise unworkable, to be reached by imbibition or solubilization.

A second advantage, obtained by the installation of the invention, consists in alternating, for each well, the periods of production of the deposit followed by periods of raising the pressure in the deposit during which an injection of hydrocarbon condensates will be effected. The fluids produced by the deposit and mixed with the hydrocarbon condensates are stored at the bottom of the well during the flow of the deposit and are ejected by a flushing gas, preferably the gas associated with the crude oil recovered at the surface and recompressed with extraction of the hydrocarbon condensates, during the periods of rising pressure in the deposit.

A third advantage of the invention consists in that flow of the crude oil in the matrix of the deposit is promoted by leaching with hydrocarbon condensates extracted preferably from the effluent of the deposit and reinjected into the deposit. This injection is carried out discontinuously, preferably during the periods of rising pressure in the deposit, so that the condensates may penetrate into the matrix, which leads to several effects contributing to an increase in recovery of the fluids from the deposit and productivity of the wells.

A fourth advantage is that, since an excess of condensate will be produced day after day, this excess volume is stored and periodically injected into at least one well whose production cycle will be stopped for a sufficient time, so as to allow the injection itself then imbibition of the matrix of the deposit in regions further and further away which would not be reached by injections carried out during normal production cycles. When the exhaustion of the deposit is judged sufficient, the whole of the excess condensates available will be injected into one or more wells and displaced to the other wells remaining in production by pumping a displacement fluid characterized by a favorable mobility ratio between the displacement fluid and the condensates so as to effect a sweep whose displacement front will be stabilized and thus improve the recovery of the crude oil still contained in the deposit.

A fifth advantage brought by the invention is that a part of the condensates is injected, continuously or discontinuously, at the head of the main casing 1 through an automatic or manual valve so as to avoid, more especially during starting up periods, coagulation of the oil which has undergone cooling in the upper part of the well.

Furthermore, this improvement will allow physicochemical agents to be added directly into the well for controlling or overcoming problems which may arise subsequently in the production installations, such as foaming or emulsification.

It also allows the density and the viscosity of the oil or of the mixture rising from the depths of the well to be adjusted.

The injection of this condensate may be effected in the annular part of the well by means of a separate pipe, or conjointly with the injection of the propulsive gas required for ejecting the fluids from the well if this latter is required for ensuring the output of the well.

A sixth advantage obtained by the invention is that, in the part of the well subjected to their effects, the temperature variations are compensated for which are caused by the expansion of the propulsive gas or other, and/or the lowering of temperature corresponding to the geothermic gradient during the filling and stabilizing phases of the well, these latter possibly leading to the deposition and/or accumulation of the components of the crude oil having a high coagulation point or high viscosity, thus hindering or preventing correct implementation of the process of the main patent.

With reference to FIG. 1, an electric resistance heating, hot fluid or vapor coil system 20 may be installed in the upper part of the well. It may be self regulating or regulated by a known device based on the output temperature of the effluent for example.

A seventh advantage is that the condensates may be stabilized which come from the recovery units (references 9 and/or 6 in the Figure of the parent patent application) placed at the surface and in particular the cold condensates containing a high amount of methane and ethane. In fact, for numerous applications, it does not seem desirable to inject into the bottom of the well and more especially into the deposit condensates which are too light and risk generating an untimely production of gas, or which may exceed the bubble point of the condensates themselves during their conveyance to the bottom of the well, thus hindering advance of the condensates through vapor lock.

This stabilization may be provided by raising the temperature and/or lowering the pressure of these condensates by a well known process with a part of the lightest components being removed and possibly reincorporated in the effluent during processing at a point such that there is compatability of pressure or that the process benefits therefrom. But it may also be provided, in order to keep an optimum quantity and/or quality of the condensate, by remixing with a part of the liquid effluent taken from or downstream of the separation unit (reference 4 of the parent patent application).

By proceeding thus it will in particular be possible to adjust the bubble point of the condensate to the variations of the thermal dynamic conditions of the deposit due to its exhaustion, or else to improve the solution to problems of water conning or gas conning, or else to particularize the composition of the condensate so as to resolve problems of oil with high coagulation point.

In this latter case, it may be desirable to bypass a part of the liquids produced into the unit 4 of the parent patent application (side stream) and to extract therefrom by conventional means an intermediate hydrocarbon fraction which will then be injected into the deposit, remixed or not with the condensates, so as to reinforce the solubilizing power depending on the application, unless this fraction serves as basis for generating a more selective solvent adapted to solve the problem posed, directly in the vicinity of the installations forming the subject of the parent patent application, with the obvious purpose of reducing costs and transport hazards and avoiding the problems of physico-chemical incompatibilities if said solvent was generated from the oil of another deposit.

FIG. 7 shows one embodiment comprising installation variants for efficiently heating the oil accumulated in the well, during its ejection phase and, conjointly, for generating the energy required for discharging the liquids up to the surface.

This is achieved, for example, by placing in the main casing 1 a sealing plug 3 pierced with one or more sealable orifices 17, 18, placed above the level of the production zone 15.

Orifice 17 receives a foot valve 6, connected or not by a pipe fitted with a strainer to the production pipe 4 itself equipped with a foot valve 7.

Orifice 18 allows a condensate injection pipe 5 to pass therethrough from the surface of the ground to the level of the production zone. It will be noted that orifice 17 may be equipped with a sealing core allowing the foot valve 6 and the condensate injection pipe 5 to pass therethrough simultaneously, in order to simplify the sealing plug 3 and the procedures for positioning the different elements.

On the surface, the well is equipped with a condensate intake pipe 13, an effluent discharge pipe 12, an air or air-gas mixture or air-pulverized hydrocarbon intake duct 44 through a carburetor of a known model 45, this latter pipe possibly extending inside casing 1 and ending in a strainer 46 distributing the air or injected mixture over a certain height into the upper part of the main casing 1, a discharge pipe 47 having a pressure valve 48 and finally an ignition means 49 provided by a hot point, electric arc or similar.

The operation of this installation will then be as follows: as soon as the level in the well has reached a level judged sufficient 50, air or a fuel-air mixture is injected through pipe 46. As soon as the volume and especially the pressure at the head of casing 1 has reached a value unlikely to place the installation in danger after explosion, the mixture is ignited by means of device 49. The explosion dampened by the volume of underlying hydrocarbon gas not participating in the combustion for lack of combustive, will create an overpressure which closes the foot valve 6 and drives a part of the liquids accumulated in the main casing 1 as far as the surface through pipe 4 and through the foot valve 7. The liquids thus driven will be heated during their transit in pipe 4 through zone where the combustion has developed.

As soon as the liquids cease to flow to the surface through pipe 4, pipe 47 will be opened at the surface so as to allow the burnt gases to be discharged as well as the well to be filled through the pressure of the layer. The well will thus be ready for a new cycle.

If a drop of the liquids in pipe 4 is accepted at the end of flushing or if a part of the gas may escape through the lower end of pipe 4, the foot valve 7 may be omitted such as shown in FIG. 7*b* in the partial view of the well bottom.

With reference to FIG. 7*c*, if the volume of liquids accumulated in the low part of the main casing 1 is small, the reduction of the dead space 55 at the well head will be obtained by placing a sealed lining 56 at its lower end or not, in order to adjust the pressure and the volume of the flushing gases and create an interchangeable enclosure in the top part of the well in contact with the combustion and relatively intense corrosion.

One or more of the above described improvements may be used simultaneously depending on the conditions of the deposit and the problem to be solved.

What is claimed is:

1. A production installation for implementing the process for bringing hydrocarbon deposits into production comprising:

at least one sealed casing extending from the surface down to below a hydrocarbon-bearing deposit, said casing being open on the front of said deposit in order to allow the flow of effluent from said deposit into said casing;

at least one sealing plug located inside said sealed casing and above the top of said deposit, said sealing plug being provided with a hole therethrough into which a check valve is installed, said hole and check valve allowing deposit effluent to flow through the sealing plug, and said sealing plug forming a capacity with the upper part of said casing;

at least one duct opening into the upper part of said capacity, said duct allowing either removal therefrom or injection thereinto of a pressurized gas;

a condensate injection tube passing through the capacity and through the sealing plug and opening below the sealing plug on the front of the deposit;

a production pipe passing through said capacity, said pipe communicating in its upper part with an effluent discharge pipe and in its lower part with said capacity through a second check valve, said production pipe check valve and said sealing plug check valve forming a valving system providing an operating cycle comprising:

(a) during an initial phase, the valving system lets the deposit effluent pass through the inside of the capacity which then fills up, (b) during a second phase during which a pressurized gas is injected into the capacity through said duct, said valving system prevents the deposit effluent contained in said capacity from returning to the deposit, whereas said valving system allows the deposit effluent to pass through the production pipe to the effluent discharge pipe, the second phase further comprising simultaneous injection of condensates into the deposit, and (c) during a third phase the valving system retains the deposit effluent in the production pipe and allows the effluent mixed with the condensates injected into the deposit to pass to the capacity, so that a new cycle may begin; and means for transferring the pressurized gas accumulated in the capacity at the end of liquid flushing into another well equipped with a similar installation and ready to be flushed until a pressure balance is obtained between the two wells.

2. The installation as claimed in claim 1, wherein said valving system comprises, in the lower part of the production pipe, at least one foot check valve situated downstream of an orifice communicating between the production pipe and said capacity.

3. The installation as claimed in claim 1, wherein said valving system comprises, in the lower part of the production pipe, two foot check valves disposed in series and said orifice communicating between said production pipe and said capacity is situated between said two valves.

4. A production installation for implementing the process for bringing hydrocarbon deposits into production comprising:

at least one sealed casing extending from the surface down to below a hydrocarbon-bearing deposit, said casing being open on the front of said deposit in order to allow the flow of effluent from said deposit into said casing;

at least one sealing plug located inside said sealed casing and above the top of said deposit, said sealing plug being provided with a hole therethrough into which a first check valve is installed, said hole and check valve allowing deposit effluent to flow through the sealing plug, and said sealing plug forming a capacity with the upper part of said casing;

at least one duct opening into the upper part of said capacity, said duct allowing either removal therefrom or injection thereinto of a pressurized gas;

a condensate injection tube passing through the capacity and through the sealing plug and opening below the sealing plug on the front of the deposit;

a production pipe passing through said capacity, said pipe communicating in its upper part with an effluent discharge pipe and in its lower part with said capacity through a second check valve, said production pipe check valve and said sealing plug check valve forming a valving system providing an operating cycle comprising:

(a) during an initial phase, the valving system lets the deposit effluent pass through the inside of the capacity which then fills up, (b) during a second phase during which a pressurized gas is injected into the capacity through said duct, said valving system prevents the deposit effluent contained in said capacity from returning to the deposit, whereas said valving system allows the deposit effluent to pass through the production pipe to the effluent discharge pipe (gas flushing), the second phase further comprising simultaneous injection of condensates into the deposit, and (c) during a third phase the valving system retains the deposit effluent in the production pipe and allows the effluent mixed with the condensates injected into the deposit to pass to the capacity, so that a new cycle may begin;

wherein, for the purpose of using said production pipe either for removal therefrom or injection thereinto of a pressurized gas and said duct opening into the upper part of said capacity for the passage of said effluent, said casing is used instead of said production pipe, said production pipe is used instead of said casing and said casing is closed by a second sealing plug through which passes the condensate injection pipe, said second plug located above said first plug, wherein these two plugs define an intermediate chamber into which the production pipe used as said casing opens, wherein a second capacity, which is then defined above the upper plug, communicates with the intermediate chamber through a duct equipped with a third check valve which provides a flow direction the same as the second check valve located at the bottom of the production pipe, wherein the lower plug comprises a passage to the deposit equipped with the first check valve and wherein the casing may further comprise, in its upper part, a discharge duct for discharging the effluent and the condensate.

5. A production installation for implementing the process for bringing hydrocarbon deposits into production comprising:

at least one sealed casing extending from the surface down to below a hydrocarbon-bearing deposit, said casing being open on the front of said deposit in order to allow the flow of effluent from said deposit into said casing;

at least one sealing plug located inside said sealed casing and above the top of said deposit, said sealing plug being provided with a hole therethrough into which a check valve is installed, said hole and check valve allowing deposit effluent to flow through the sealing plug, and said sealing plug forming a capacity with the upper part of said casing;

at least one duct opening into the upper part of said capacity, said duct allowing either removal therefrom or inection thereinto of a pressurized gas;

a condensate injection tube passing through the capacity and through the sealing plug and opening below the sealing plug on the front of the deposit;

a production pipe passing through said capacity, said pipe communicating in its upper part with an effluent discharge pipe and in its lower part with said capacity through a second check valve, said production pipe check valve and said sealing plug check valve forming a valving system providing an operating cycle comprising:

(a) during an initial phase, the valving system lets the deposit effluent pass through the inside of the capacity which then fills up, (b) during a second phase during which a pressurized gas is injected into the capacity through said duct, said valving system prevents the deposit effluent contained in said capacity from returning to the deposit, whereas said valving system allows the deposit effluent to pass through the production pipe to the effluent discharge pipe (gas flushing), the second phase further comprising simultaneous injection of condensates into the deposit, and (c) during a third phase the valving system retains the deposit effluent in the production pipe and allows the effluent mixed with the condensates injected into the deposit to pass to the capacity, so that a new cycle may begin; and an additional sealing plug mounted in the upper part of the casing so as to separate said capacity into two chambers, namely an upper chamber for storing a gas or the condensates and a lower chamber fulfilling the functions of said capacity, said additional plug having passing therethrough at least the production pipe, the condensate injection pipe and a pipe passing through the upper chamber and serving as inlet and outlet for the flushing gas for the lower chamber said installation comprising in addition a plunging pipe for supplying the upper chamber with gas or removing gas therefrom as well as for draining, if required, the existing liquids or the liquids which may accumulate in the lower part of said chamber.

* * * * *